US005433177A

United States Patent [19]

Suzuki

[11] Patent Number: 5,433,177

[45] Date of Patent: Jul. 18, 1995

[54] LUBRICATING SYSTEM FOR ENGINE

[75] Inventor: Akitaka Suzuki, Iwata, Japan

[73] Assignee: Yamaha Hatsudoki Kabushiki Kaisha, Iwata, Japan

[21] Appl. No.: 133,971

[22] Filed: Oct. 8, 1993

Related U.S. Application Data

[62] Division of Ser. No. 885,660, May 19, 1992, Pat. No. 5,297,511.

[30] Foreign Application Priority Data

Feb. 15, 1992 [JP] Japan ..... 4-061435

[51] Int. Cl.[6] ..... F01M 3/02

[52] U.S. Cl. ..... 123/73 AD; 123/196 R

[58] Field of Search ..... 123/73 AD, 196 R; 184/7.4

[56] References Cited

U.S. PATENT DOCUMENTS

| | | | |
|---|---|---|---|
| 2,796,075 | 6/1957 | Focht . | |
| 3,447,636 | 6/1969 | Bonfilio . | |
| 4,286,632 | 9/1981 | Abel . | |
| 4,697,553 | 10/1987 | Lie . | |
| 4,887,559 | 12/1989 | Hensel et al. . | |
| 4,967,700 | 11/1990 | Torigai . | |
| 5,020,484 | 6/1991 | Ishikawa et al. . | |
| 5,167,207 | 12/1992 | Gohara et al. | 123/196 R |
| 5,235,944 | 8/1993 | Adachi . | |
| 5,297,511 | 3/1994 | Suzuki | 123/196 R |

FOREIGN PATENT DOCUMENTS

| | | | |
|---|---|---|---|
| 2437491 | 5/1980 | France | 123/73 AD |
| 949855 | 9/1956 | Germany . | |
| 01044711 | 5/1980 | Japan . | |
| 0096411 | 6/1984 | Japan | 123/73 AD |
| 62-131908 | 12/1985 | Japan . | |
| 192505 | 10/1987 | Japan . | |
| 2191807 | 7/1990 | Japan . | |
| 2118110 | 9/1990 | Japan . | |
| 2118111 | 9/1990 | Japan . | |
| 2139307 | 11/1990 | Japan . | |

OTHER PUBLICATIONS

Patent abstract of Japan vol. 9, No. 231(M414) (1854) 18 Sep. 1985 & JP A 60 88 811 (Sanshin Kogyo KK) 18 May 1985.

European Search Report dated Apr. 3, 1993.

*Primary Examiner*—Henry C. Yuen

*Assistant Examiner*—Erick Solis

*Attorney, Agent, or Firm*—Knobbe, Martens Olson & Bear

[57] ABSTRACT

A lubrication system for the internal combustion engine of a motorcycle that includes a pump that outputs a constant amount of fluid per cycle of operation and a delivery valve which selectively passes lubricant to the engine or returns lubricant back to the system to vary the amount of lubricant supplied by the lubricant pump. The system is designed so as to self purge air from the system by mounting the lubricant pump and the delivery valve in close proximity to each other and at a lower level than the lubricant storage tank. In addition, the engine is supplied with lubricant from the supply outlet through a conduit that terminates at a point higher than the supply outlet so as to preclude lubricant from draining into the engine when the engine is not running.

15 Claims, 4 Drawing Sheets

LUBRICATING SYSTEM FOR ENGINE

This is a division of U.S. patent application Ser. No. 07/885,660, filed May 19, 1992, now U.S. Pat. No. 5,297,511.

BACKGROUND OF THE INVENTION

This invention relates to a lubricating system for an engine and more particularly to a separate lubricating system that insures that the desired amount of lubricant will be supplied to the engine under all running conditions and only when the engine is running.

Heretofore it has been the practice to lubricate two cycle internal combustion engines by mixing lubricant with the fuel supplied to the engine. Although such an arrangement has the advantage of simplicity, it results in excess consumption of lubricant because it is necessary to maintain a lubricant/fuel mixture that will supply the most severe condition under which the engine is expected to operate. Hence, excess lubricant is supplied to the engine under most running conditions.

To avoid these problems, it has been proposed to provide a separate lubricating system for two cycle engines. One type of system is disclosed in the co-pending application entitled "Lubricating Oil Supplying System For A Two Cycle Engine", Ser. No. 862,984, filed Apr. 7, 1982 in the name of Yoshinobu Yashiro and assigned to the Assignee hereof. As is disclosed in that application, a reciprocating type of lubricating pump is driven by the engine and supplies a finite amount of lubricant during each cycle of its operation. A delivery valve is interposed in the outlet from the lubricant pump and controls the amount of lubricant supplied to the engine by sequentially supplying lubricant to the engine or returning lubricant back to the inlet side of the pump. The duty cycle of the valve is changed in response to engine running and other condition so as to control the amount of lubricant supplied.

Lubrication systems of the type described are extremely effective in providing good control of the lubricant, adequate lubrication under all circumstances and a minimum of lubricant consumption and smoke in the exhaust of the engine. However, there is always the possibility that lubricant may be carried entrain air. If air is entrained in the lubricant, then the duty cycle of the valve may not provide adequate control of the amount of lubricant supplied. That is, if there is air in the lines the lubricant will expand and contract and displace lubricant so that in a given time period of supply of the flow controlling valve, varying amounts of lubricant may be supplied.

It is, therefore a principal object to this invention to provide an improved lubricating system for an engine that will insure that the desired amount of lubricant is supplied under all conditions.

It is a further object to this invention to provide a lubricating system for an engine wherein the problems of air entrainment in the lubricant are minimized.

If the conduit between the lubricant pump and the flow controlling valve is long then there is an increased possibility of variations in the amount of lubricant supplied due to air entrainment. By keeping the conduit as short as possible, the effect of air in the lubricant may be minimized.

It is, therefore, a still further object to this invention to provide an improved arrangement wherein the distance between the lubricating pump and the delivery valve is minimized.

Since it is readily acknowledged that air can be entrained in the lubricant in the lubricating system, it is also desirable to design the system in such a way that the air will be purged from the system before it can be delivered to the engine.

It is, therefore, a still further object to this invention to provide an improved arrangement which will insure that air entrained in the lubricant can be purged from the system before it is delivered to the engine.

It is a further object to this invention to provide a delivery valve for a lubricating system that is oriented in such a way that the return lubricant will also bleed the air out of the system.

A further problem with separate lubricating systems for engines and particularly two cycle engines is that lubricant may drain into the engine after the engine is shut off. If this occurs, numerous problems can arise. Not only is oil consumption increased, but also the likelihood of smoke in the exhaust is increased. Furthermore, the lubricant flowing into the engine may foul the spark plug and make engine running uneven or, in extreme cases, make starting impossible.

It is, therefore, a still further object to this invention to provide a lubricating system for an engine that will insure that lubricant can not drain into the engine when the engine is shut off.

SUMMARY OF THE INVENTION

A number of features of the invention are adapted to be embodied in a lubricating system for an internal combustion engine that is comprised of a lubricant tank for containing a lubricant. A lubricant pump having an inlet and outlet is provided for pumping lubricant. A first conduit supplies lubricant from the lubricant tank to the inlet of the lubricant pump. A delivery valve is operable to direct lubricant from an inlet to either of a supply outlet or a return outlet for controlling the amount of lubricant supplied to the engine. A second conduit connects the lubricant pump outlet to the delivery valve inlet. A third conduit returns lubricant from the return outlet of the delivery valve to a point in the system upstream of the lubricant pump inlet. A fourth conduit connects the supply outlet of the delivery valve to the engine for its lubrication.

In accordance with a first feature of the invention, the delivery valve and the lubricant pump are positioned in close proximity to each other to minimize the length of the second conduit.

In accordance with another feature of the invention, the return outlet of the delivery valve is positioned at a location that is above the supply outlet of the delivery valve so that air may bleed from the system through the return outlet.

In accordance with another feature of the invention, the fourth conduit interconnects with the engine at a point above its connection to the supply outlet of the delivery valve so that lubricant will not flow to the engine when the engine is shut off.

Another feature of the invention is adapted to be embodied in a delivery valve for controlling the flow of lubricant from a pump to an engine. The delivery valve is comprised of a housing having a lubricant inlet, a supply outlet and a return outlet. A valve is positioned in the housing for controlling the communication of the inlet with either the supply outlet or the return outlet.

In accordance with this feature of the invention, the return outlet is positioned above the supply outlet.

DETAILED DESCRIPTION OF THE PREFERRED EMBODIMENT OF THE INVENTION

Figure 1:
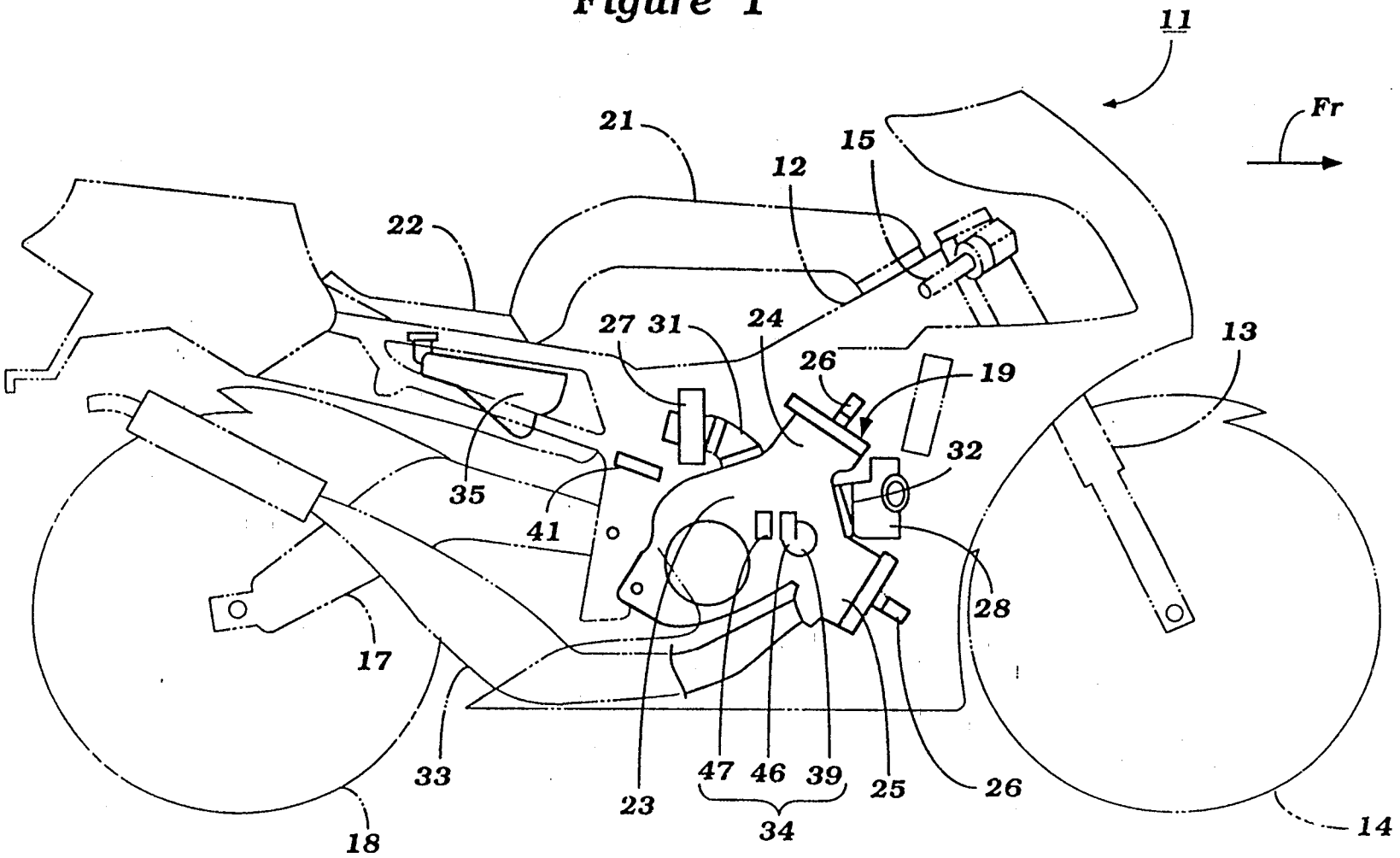
FIG. 1 is a side elevational view of a motorcycle powered by an internal combustion engine having a lubricating system constructed in accordance with an embodiment of the invention. The motorcycle is generally shown in phantom while the engine and its lubricating system are shown in solid lines.
Figure 2:
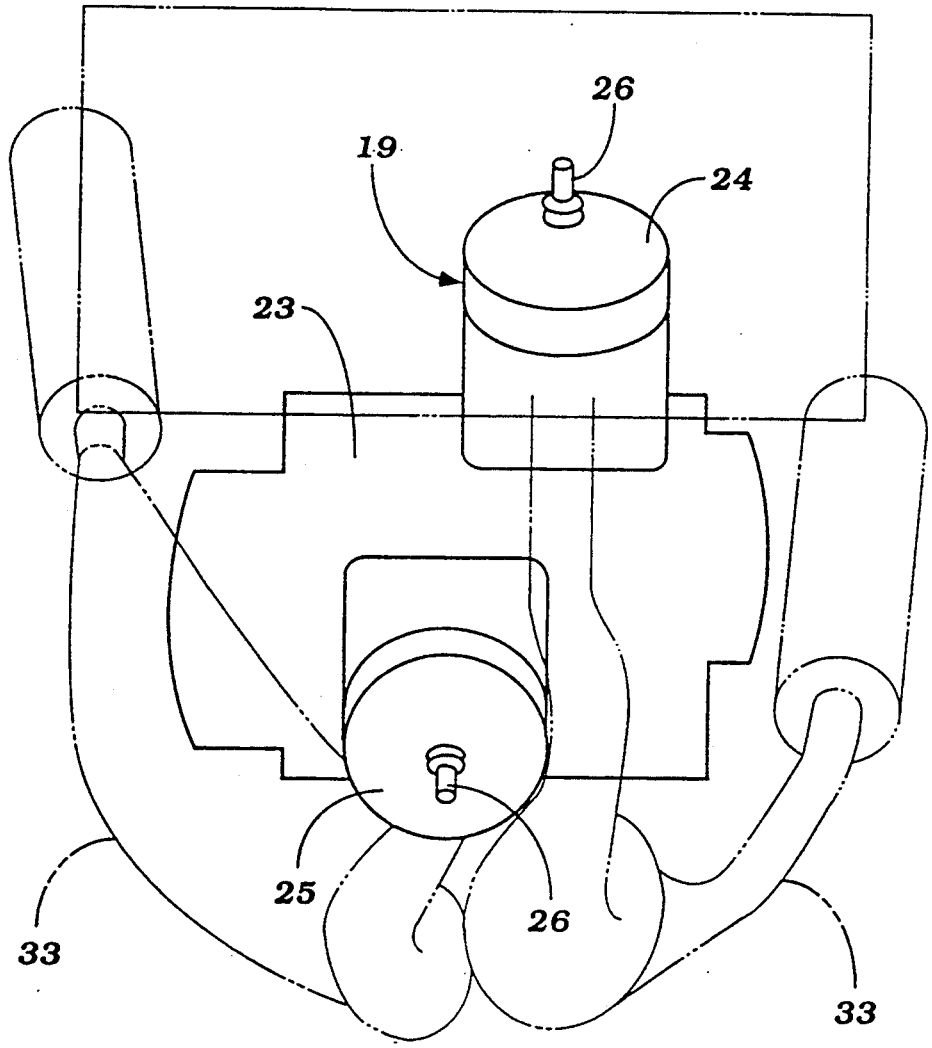
FIG. 2 is a front elevational view, oh an enlarged scale, showing the engine and surrounding portions of the motorcycle.

Referring first to FIG. 1, a motorcycle is shown partially in phantom and is identified generally by the reference numeral 11. The motorcycle 11 is depicted primarily for orientation purposes inasmuch as the lubricating system may be used in conjunction with other applications for internal combustion engines. A motorcycle, however, is a typical environment in which the invention may be employed since it has particular utility with two cycle internal combustion engines and such engines are frequently employed for powering motorcycles.

The motorcycle 11 includes a frame assembly, indicated generally by the reference numeral 12 that dirigibly supports a front fork 13. The front fork 13 journals a front wheel 14 and is steered by means of a handlebar assembly 15 in a known manner. A trailing arm assembly 17 is journaled at the rear of the frame assembly 12 in a known manner and rotatably journals a rear wheel 18. The rear wheel 18 is driven by an internal combustion engine, indicated generally by the reference numeral 19, and which is mounted in the frame assembly 12 in a known manner.

A fuel tank 21 is carried by the frame assembly 12 above the engine 19 and supplies fuel to the engine 19 in a known manner. A seat 22 is mounted on the frame assembly 12 to the rear of the fuel tank 21 for accommodating a rider.

The engine 19 is, in the illustrated embodiment, of the V-2 two cycle, crankcase compression type. It is to be understood, however, that the invention may be employed with engines having other cylinder numbers or other configurations, engines operating on other than the two stroke principal and also rotary type engines.

The engine 19 includes a cylinder block assembly 23 having a pair of angularly disposed cylinder banks 24 and 25, each forming a cylinder bore. As is typical with motorcycle practice, the cylinder block 23 is mounted in the frame assembly 12 so that the output shaft rotates about a transversely extending axis. A suitable change speed transmission is incorporated within the crankcase of the cylinder block 23 and drives the rear wheel 18 in any suitable manner. Cylinder heads are affixed to the cylinder banks 24 and 25 and each mount respective spark plugs 26 for firing the charge which is delivered to the combustion chambers of the engine in a well known manner.

Figure 3:
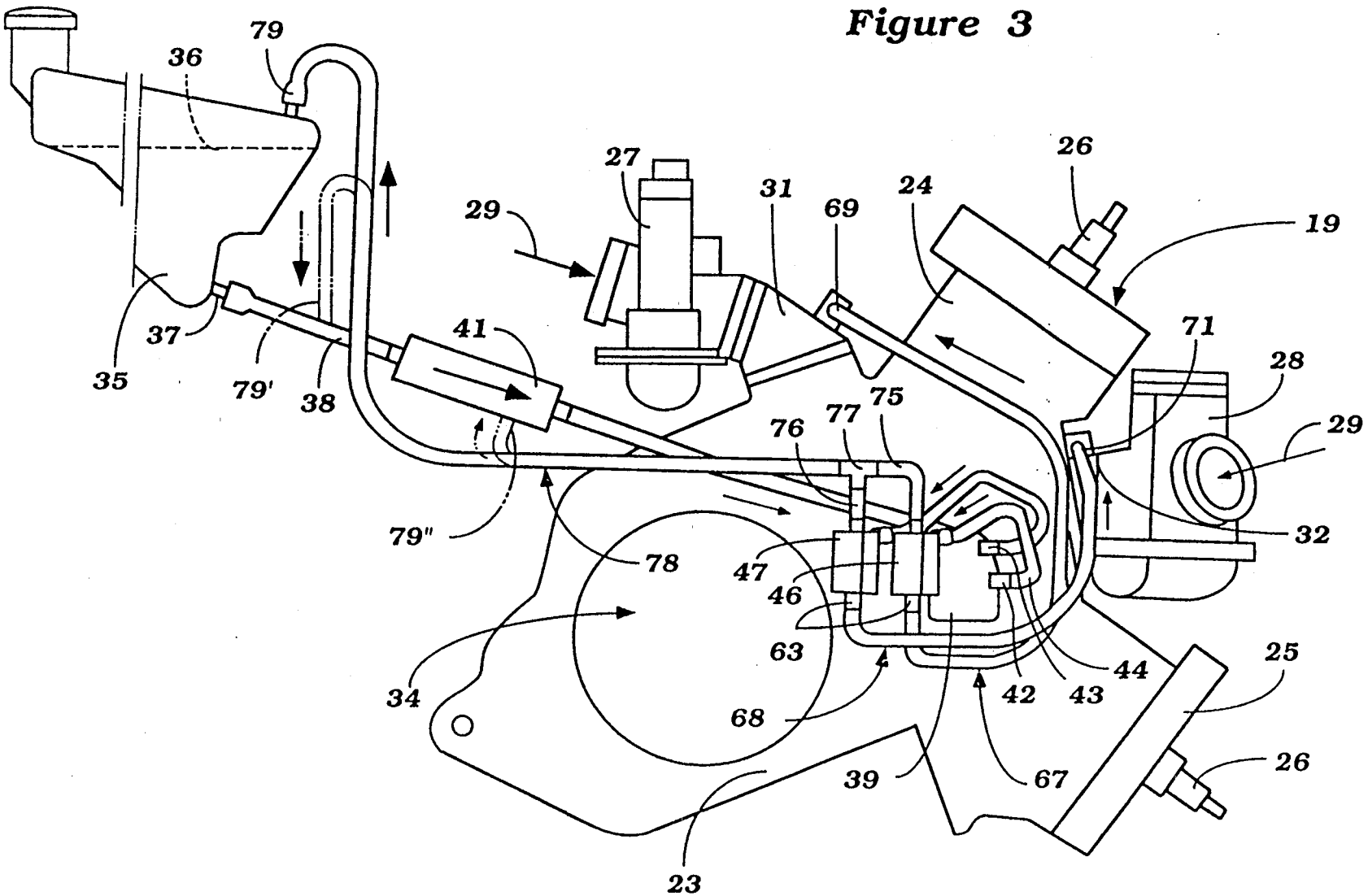
FIG. 3 is an enlarged side elevational view, in part similar to FIG. 1, and shows only the engine and the lubricating system.

The induction system includes a pair of carburetors 27 and 28 which draw air through an air cleaner system, as shown schematically by the arrows 29 in FIG. 3. The carburetors 27 and 28 discharge into the crankcase chambers associated with the individual cylinder banks 24 and 25 through respective intake manifolds 31 and 32.

In connection with the orientation of the engine 19, the front and rear sides of the engine are related to the front and rear of the motorcycle 11 with the front indicated by the arrow Fr. In addition to the front and rear sides, the engine 19 has a top side, a bottom side, a left hand side and a right hand side, all oriented relative to the body of the motorcycle 11. As used in the claims "sides" may be any of such sides.

A pair of exhaust pipes and muffler arrangements 33 extend from the exhaust ports of the respective cylinder banks 24 and 25 on opposite sides of the motorcycle 11 and discharge exhaust gases to the atmosphere in a well known manner.

No details of the internal construction of the engine 19 have been illustrated nor is any further description of the basic construction of the engine 19 believed to be necessary to permit those skilled in the art to understand the construction and operation of the invention, which relates primarily to the lubricating system for the engine 19. This lubricating system is indicated generally by the reference numeral 34 and will now be described in greater detail by particular reference initially to FIGS. 1 and 3.

The lubricating system 34 includes a lubricant tank 35 that is mounted at the rear of the frame assembly 12 at an elevated position. The lubricant tank 35 contains lubricant at a level indicated by the broken line 36 in FIG. 3 which, it should be noted, lies above the upper level of the engine 19.

An outlet nipple 37 of the lubricant tank 35 is connected to a first conduit 38 for gravity delivery of lubricant from the tank 35 to a lubricating pump, indicated generally by the reference numeral 39 and mounted at one side of the engine (the right hand side in the illustrated embodiment). An oil filter 41 is provided in the first conduit 38 for filtering the lubricant before it is delivered to the lubricant pump 39.

The lubricant pump 39 may be a conventional reciprocating type pump that is driven by the engine in a suitable manner. The pump 39 has a pair of outlet fittings 42 and 43 to which one end of second conduits 44 and 45 are affixed. The opposite ends of the conduits 44 and 45 are connected to inlet fittings of respective delivery valves 46 and 47, each having a construction as shown in FIG. 4.

Figure 4:
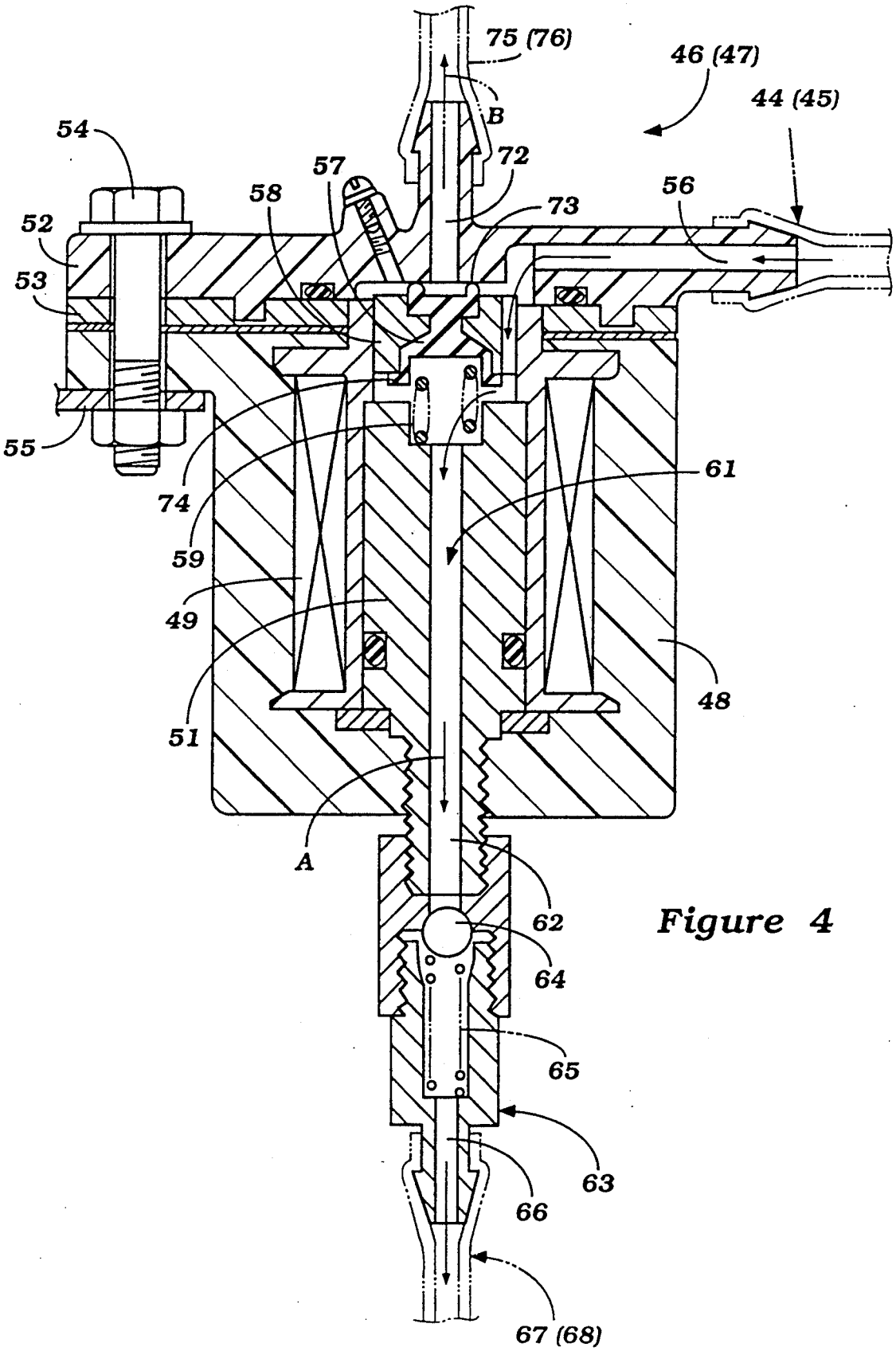
FIG. 4 is an enlarged cross sectional view taken through one of the delivery valves.

Referring specifically to FIG. 4, the delivery valves 46 and 47 each are comprised of an outer housing 48 having an internal cavity in which a solenoid winding 49 is provided. The winding 49 encircles a core 51. This cavity is closed by means of a cover plate 52 that is affixed to an outwardly extending flange of the outer housing 48 with an interposed gasket 53 by means of threaded fasteners 54. The fasteners 54 also secure the delivery valves 46 and 47 to the side of the engine 19 and specifically the cylinder block 23 closely adjacent the lubricant pump 39 so as to minimize the length of the conduits 44 and 45. A mounting bracket 55 is affixed to the cylinder block 23 for mounting purposes.

An inlet passage 56 is formed in the cover plate 52 and receives the ends of the respective conduits 44 and 45 so as to permit lubricant to flow under pressure from the pump 39 into an internal cavity 57 formed within the cover plate 52. A slideably supported valve member 58 is mounted in the core 51 and has a ferromagnetic portion that is operated on by the winding 49 so as to effect a changing flow path from the lubricant pump 39.

A coil compression spring 59 normally urges the valve member 58 upwardly and opens communication with a delivery passage 61 formed centrally in the core 51 and which has an outlet fitting 62 formed at its lower end. A check valve 63 is connected to the outlet fitting 62 and functions to permit flow from the passage 61 to the engine, in a manner to be described, while precluding flow in the opposite direction. In addition, the check valve 63 will function to prevent any drainage of lubricant when the engine 19 is not running.

The check valve 63 includes a ball type valve member 64 which is urged by a coil compression spring 65 to a normally closed position. When the pressure is exerted in the passage 61, the ball valve member 64 will be urged downwardly against the action of the coil spring 65 and lubricant may flow from a discharge fitting 66 to the engine through conduits 67 and 68.

The conduits 67 and 68, as may be best seen in FIG. 3, extend to lubricant discharges 69 and 71, respectively, which are tapped into the intake manifolds 31 and 32. Although in the illustrated system there is one lubricant fitting 69 and 71 for each intake manifold 31 and 32, it is to be understood that various other ways of delivering the lubricant to the engine 19 other than through its intake manifolds may be employed in conjunction with the invention. It is important, however, to note that the fittings 69 and 71 are positioned at a higher level than the outlet of the discharge fittings 66 from the delivery valves 46 and 47. This insures that lubricant also will not drain from the delivery valves 46 and 47 to the engine when the engine is not running. In addition, by providing the supply outlet fitting 62 at the lower portion of the delivery valves 46 and 47, it will be insured that air is less likely to flow through the delivery valves 46 and 47 to the engine.

Returning again to FIG. 4, a return passage 72 is formed in the cover plate 52 and communicates with the chamber 57. The return passage 72 is normally closed by a seal 73 of the valve member 58 when the valve member 58 is in the position shown in FIG. 4. However, when the solenoid winding 49 is energized, a seal portion 74 will engage and close the passage 61 while opening the return passage 72. Lubricant is then returned to the lubricant tank 35 through a pair of return conduits 75 and 76 which merge at a T-connection 77. The T-connection 77 is connected to a conduit 78 which extends back to a return fitting 79 of the lubricant tank 35 positioned above the normal lubricant level therein. Because of this elevated orientation, air which may be entrapped in the lubricant will flow by gravity upwardly and be collected in the chambers 58 for return along with the lubricant to the tank 35 during the non-delivery portion of the cycle.

It is desirable to insure that the return paths from each of the delivery valves 46 and 47 has substantially the same flow resistance. This will insure equal flow when the delivery valves are in either position and will prevent any irregularities in the amount of lubricant supplied to the engine 19. Therefore, the conduits 75 and 76 are configured to have the same effective cross sectional flow area and substantially the same length. Rather than use a T-connection as the connection 77, a Y-connection may also be employed and this will provide even greater balancing in the flow resistance in the two return paths.

As described in the aforenoted co-pending application Ser. No. 862,984, the amount of lubricant delivered to the engine is controlled by varying the duty cycle and time when the solenoid winding 49 is energized.

In the embodiment as thus far described, the return lubricant has been returned directly to the tank 35. It is to be understood, however, that the lubricant may be returned anywhere to the system but preferably upstream of the filter 41. Flow may be returned either to the conduit 37 upstream of the filter 41 as shown by the alternative location 79' or to the upstream side of the filter element 41 as shown by the phantom line position 79" in FIG. 3.

The described system is extremely effective in insuring against variations in the amount of lubricant delivered to the engine as might be caused by air entrainment and also avoids against the draining of lubricant into the engine during such times when the engine is not operated. The foregoing feature is achieved by positioning the lubricant pump 39 and delivery valves 46 and 47 in close proximity to each other so as to minimize the length of the conduits 44 and 45. In fact, the delivery valves and lubricant pump may be contained within a common body. In addition, the fact that the return outlet 72 is at the upper portion of the delivery valves also assist in air extraction. The low position of the supply outlet 62 and the use of the check vale 63 insures against draining of the lubricant to the engine when the engine is not operating. Of course, the foregoing description is that of a preferred embodiment of the invention and various changes and modifications may be made without departing from the spirit and scope of the invention, as defined by the appended claims.

I claim:

1. A lubricating system for an internal combustion engine comprising a lubricant tank for containing a lubricant, a lubricant pump having an inlet and an outlet for pumping lubricant, a first conduit for supplying lubricant from said lubricant tank to said lubricant pump inlet, a delivery valve operable to direct lubricant from an inlet to either of a supply outlet or a return outlet for controlling the amount of lubricant supplied, a second conduit connecting said lubricant pump outlet to said delivery valve inlet, a third conduit for returning lubricant from said return outlet of said delivery valve to a point in said system upstream of said lubricant pump inlet, and a fourth conduit connecting said supply outlet of said delivery valve to said engine for its lubrication at a point vertically above said delivery valve outlet for precluding the flow of lubricant by gravity to said engine, said delivery valve and said lubricant pump being in close proximity to each other for minimizing the length of said second conduit.

2. A lubricating system as set forth in claim 1 wherein the lubricant pump and the delivery valve are both disposed on the same side of the engine.

3. A lubricating system as set forth in claim 2 wherein the lubricant pump and the delivery valve are both mounted on the engine.

4. A lubricating system as set forth in claim 1 further including a filter for filtering the lubricant supplied to the engine.

5. A lubricating system as set forth in claim 4 wherein the filter is disposed in the first conduit.

6. A lubricating system as set forth in claim 5 wherein the third conduit returns lubricant to the system upstream of the filter so that return fluid must be passed through the filter again before it can be supplied to the engine.

7. A lubricating system as set forth in claim 6 wherein the lubricant pump and the delivery valve are both mounted on the engine.

8. A lubricating system as set forth in claim 2 wherein the return outlet is positioned vertically above the supply outlet of the delivery valve for self purging of air from the system.

9. A lubricating system as set forth in claim 8 wherein the lubricant tank is positioned at a higher elevation than the lubricant pump and the delivery valve.

10. A lubricating system as set forth in claim 9 further including a filter for filtering the lubricant supplied to the engine.

11. A lubricating system as set forth in claim 10 wherein the filter is disposed in the first conduit.

12. A lubricating system as set forth in claim 11 wherein the third conduit returns lubricant to the system upstream of the filter so that return fluid must be passed through the filter again before it can be supplied to the engine.

13. A lubricating system for an internal combustion engine comprising a lubricant tank for containing a lubricant, a lubricant pump having an inlet and an outlet for pumping lubricant, a first conduit for supplying lubricant from said lubricant tank to said lubricant pump inlet, a delivery valve operable to direct lubricant from an inlet to either of a supply outlet or a return outlet for controlling the amount of lubricant supplied, a second conduit connecting said lubricant pump outlet to said delivery valve inlet, a third conduit for returning lubricant from said return outlet of said delivery valve to a point in said system upstream of said lubricant pump inlet, and a fourth conduit connecting said supply outlet of said delivery valve to said engine for its lubrication, said delivery valve and said lubricant pump being in close proximity to each other for minimizing the length of said second conduit, said return outlet being positioned vertically above said supply outlet of said delivery valve for self purging of air from the system.

14. A lubricating system as set forth in claim 13 wherein the lubricant tank is positioned at a higher elevation than the lubricant pump and the delivery valve.

15. A delivery valve for controlling the delivery of lubricant to an internal combustion engine comprising an outer housing, a lubricant inlet to said outer housing, a delivery outlet in said outer housing for delivering lubricant therefrom, a return outlet for returning lubricant from said outer housing, valve means in said outer housing for selectively controlling the flow from said lubricant inlet to either of said supply outlet or said return outlet, said supply outlet being positioned vertically below said return outlet for self purging of air from the system.

* * * * *